US011413489B2

(12) United States Patent
Wallander

(10) Patent No.: US 11,413,489 B2
(45) Date of Patent: Aug. 16, 2022

(54) SYSTEM, METHOD, AND DEVICE FOR DEVELOPING MUSCLE MEMORY AND A BALANCED SWING

(71) Applicant: William Wallander, Dallas, TX (US)

(72) Inventor: William Wallander, Dallas, TX (US)

( * ) Notice: Subject to any disclaimer, the term of this patent is extended or adjusted under 35 U.S.C. 154(b) by 114 days.

(21) Appl. No.: 15/921,140

(22) Filed: Mar. 14, 2018

(65) Prior Publication Data

US 2018/0264307 A1 Sep. 20, 2018

Related U.S. Application Data

(60) Provisional application No. 62/472,779, filed on Mar. 17, 2017.

(51) Int. Cl.

| | |
|---|---|
| ***A63B 21/055*** | (2006.01) |
| ***A63B 21/00*** | (2006.01) |
| ***A63B 69/36*** | (2006.01) |
| ***A63B 69/00*** | (2006.01) |

(52) U.S. Cl.

CPC ..... *A63B 21/0552* (2013.01); *A63B 21/4009* (2015.10); *A63B 21/4011* (2015.10); *A63B 21/4017* (2015.10); *A63B 69/0002* (2013.01); *A63B 69/0059* (2013.01); *A63B 69/3608* (2013.01); *A63B 69/0062* (2020.08); *A63B 2069/0008* (2013.01); *A63B 2225/09* (2013.01)

(58) Field of Classification Search

CPC ..... A63B 21/04–0428; A63B 21/0442; A63B 21/055–0557; A63B 21/4009–4021; A63B 21/4025; A63B 69/0002–0013; A63B 69/3608; A63B 21/4001–4021

See application file for complete search history.

(56) References Cited

U.S. PATENT DOCUMENTS

| | | | | |
|---|---|---|---|---|
| 5,336,151 | A * | 8/1994 | Van Ballegooie | A63B 21/00185 482/121 |
| 5,813,955 | A * | 9/1998 | Gutkowski | A63B 21/0004 482/121 |
| 7,608,026 | B1 * | 10/2009 | Nicassio | A63B 21/4015 482/121 |
| 9,764,180 | B2 * | 9/2017 | Bybee | A63B 21/0442 |
| 2006/0229175 | A1 * | 10/2006 | Frappier | A63B 21/00065 482/124 |
| 2013/0079201 | A1 * | 3/2013 | Morgan | A63B 21/0004 482/124 |
| 2013/0085040 | A1 * | 4/2013 | Bowers | A63B 21/0557 482/8 |

(Continued)

OTHER PUBLICATIONS

Filing receipt and specification for provisional patent application entitled "A System, Method, and Device for Developing Muscle Memory and a Balanced Swing," by William Wallander, filed Mar. 17, 2017 as U.S. Appl. No. 62/472,779.

*Primary Examiner* — Jennifer Robertson

(74) *Attorney, Agent, or Firm* — Barnes & Thornburg LLP; Jerry C. Harris, Jr.

(57) ABSTRACT

A sports swing muscle memory development device comprising attachment components, connection components, and resistance components to enable the development of swing relationship. Further embodiments allow for an adjustable swing relationship to further enhance the effectiveness of the sports swing muscle memory development device.

19 Claims, 7 Drawing Sheets

(56) References Cited

U.S. PATENT DOCUMENTS

| | | | | |
|---|---|---|---|---|
| 2014/0323271 | A1* | 10/2014 | Hinds | A63B 21/0555<br>482/8 |
| 2015/0231469 | A1* | 8/2015 | Pretz | A63B 69/0062<br>473/458 |
| 2015/0251038 | A1* | 9/2015 | Bybee | A63B 21/4025<br>482/124 |
| 2016/0008655 | A1* | 1/2016 | Martin | A63B 21/4043<br>482/124 |
| 2017/0028244 | A1* | 2/2017 | Schreiber | A63B 21/0557 |
| 2017/0140664 | A1* | 5/2017 | Arnold | A63B 21/00185 |

* cited by examiner

SYSTEM, METHOD, AND DEVICE FOR DEVELOPING MUSCLE MEMORY AND A BALANCED SWING

CROSS-REFERENCE TO RELATED APPLICATIONS

This application is a continuation of and claims priority to U.S. Provisional Application No. 62/472,779 entitled "A System, Method, and Device for Developing Muscle Memory and a Balanced Swing", and filed Mar. 17, 2017, which is incorporated herein by reference.

BACKGROUND

A successful sports swing (including golf or baseball) requires a combination of strength, flexibility, balance, coordination, weight shift, rhythmic timing, repeatability, and confidence—all delivered in the short period of time it takes to make the swing. The swing utilizes the entire body to accomplish peak hitting speed and square ball impact to maximize power and direct the ball to its intended target. Repeatability of the successful sports swing requires trained muscle memory to start, execute, and finish the sports swing. The sports swing can be successfully executed when the athlete has confidence to swing without the need to think about swing mechanics, thus performing the swing with subconscious support to maximize physical skill and intuitive mental abilities in support of successful shot completion. Keeping the motion simple and confident can help increase sports swing performance, leading to improved ball striking performance and play improvement.

SUMMARY

In an embodiment of the disclosure, a sports swing muscle memory development device may comprise a plurality of attachment components, wherein the plurality of attachment components is configured to circumferentially secure a plurality of enclosed regions of a user's body; a plurality of connection components, wherein each of the plurality of connection components is coupleable to one or more of the plurality of attachment components; and a plurality of resistance components, wherein each of the plurality of resistance components is coupleable to one or more of the plurality of connection components.

In another embodiment of the disclosure, a method for training movement of a sport swing user's hips, torso, shoulders, back, arms, hands, feet, legs, and hips may comprise attaching a sports swing muscle memory development device to the user's body; allowing slow to moderate speed motion of the user's body with focus on the muscles of the feet, legs, and hips as would occur in the sports swing; allowing slow to moderate speed motion of the user's body with focus on the muscles of the hips, torso, shoulders, back, arms and hands as would occur in the sports swing; shifting the weight front and back to further develop one or more of the muscles and gain awareness of how the muscles are used in the sports swing; and letting one or more of the muscles move naturally when shifting weight as would occur in the sports swing, developing balance and properly initiating of the sports swing.

DETAILED DESCRIPTION

Figure 1:
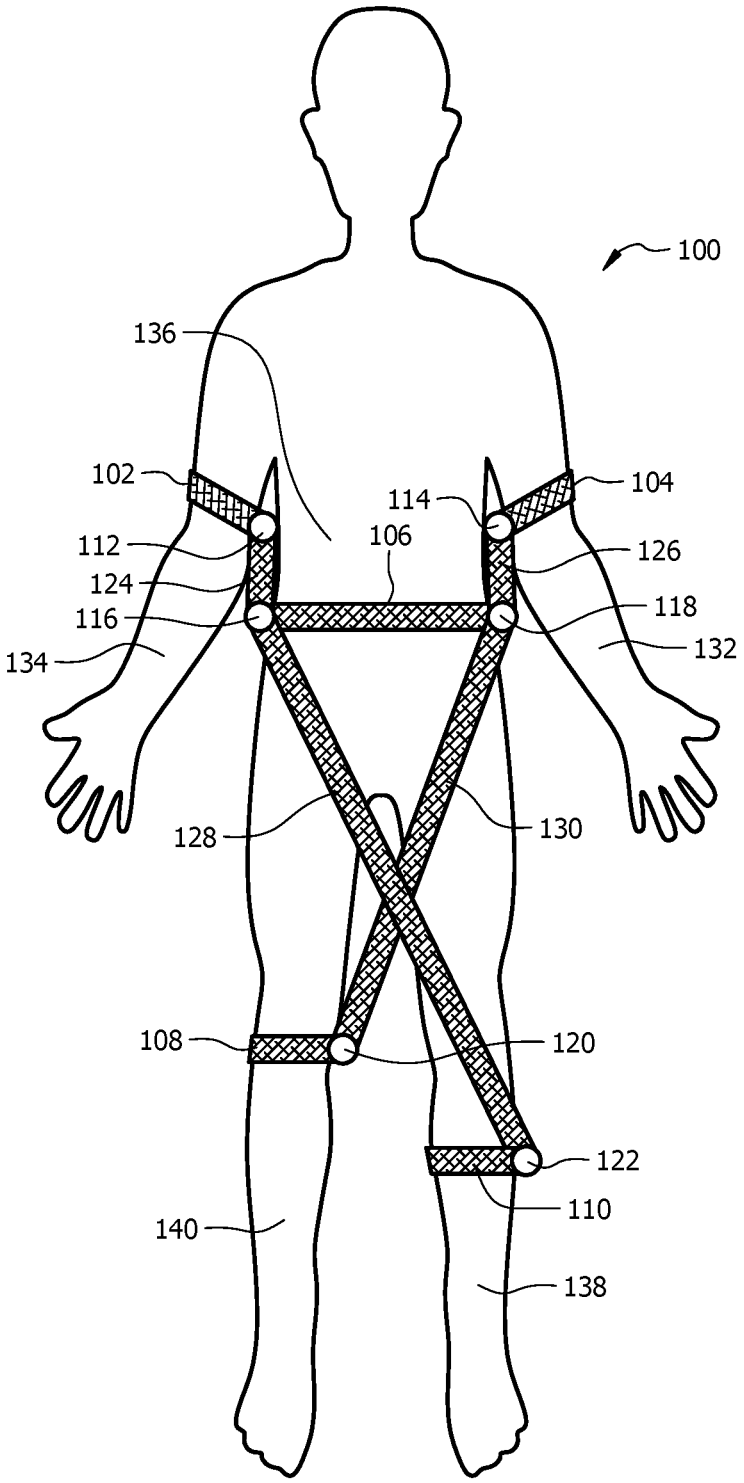
FIG. 1 illustrates an embodiment of a sports swing muscle memory development device 100.

Unless defined otherwise, technical and scientific terms used herein have the same meaning as commonly understood by one of ordinary skill in the art to which the claimed material belongs. The following terms are defined below.

"coupleable" in this context refers to being able to be mechanically joined via force(s) generated by adhesion, cohesion, friction, fastening, magnetism, tension, etc.

"fastener" in this context refers to is a hardware device that mechanically joins or affixes two or more objects together, generally used to create non-permanent joints (e.g., releasable or lockable), including anchor bolts, battens, bolts (including screws), brass fasteners, buckles, buttons, cable ties, captive fasteners, clamps (or cramps, including hose clamps), clasps (including lobster clasps), clekos, clips (including circlips, hairpin clips, paper clips, and terry clips), clutches, drawing pins (thumbtack), flanges, frogs, grommets, hook-and-eye closures, hook and loop fasteners (including Velcro), latches, nails, pegs (including clothespins and tent pegs), PEM nuts, pins (including bowtie cotter pins, circle cotters, clevis fasteners, cotters, dowels, linchpins, R-clips, split pins, spring pins, and tapered pins), retaining rings (including circlips and e-rings), rivets, rock bolts, rubber bands (or bands of other materials), screw anchors, snap fasteners, staples, stitches, straps, threaded fasteners (including captive threaded fasteners, nuts, screws, washers, threaded inserts, and threaded rods), ties, toggle bolts, treasury tags, twist ties, wedge anchors, and zippers.

The sports swing is a complex movement that is best accomplished by the interaction of the alternating contraction and relaxation of opposing muscle groups. Because this movement occurs in less than two seconds and must be coordinated to the millisecond, it cannot be controlled by conscious thought. It must be trained in harmony with the subconscious mind. Thus while in training, it is desirable that athletes have continuous information and feedback throughout the entire movement that they are maintaining the correct relationship between the feet, legs, hips, torso, arms, neck, and head when making the sports swing, all of which are tied to the body core trained by the device. One facet of the uniqueness of this training device and system is that it works all of the needed muscle groups from the bottom up based on specifically placed connection points and configuration of resistance components attached to the each of the arms and legs to create not just the correct swing, but also to develop muscle memory, strength, and flexibility in the swing to enhance coordination and power, as well as to provide rehabilitative training.

Embodiments disclosed herein comprise a device configured to utilize 360 degrees of resistance combined with core and other muscle attachment placement and release mechanisms to develop core and other muscle memory, strength, and flexibility. The device further supports weight shift and turn coordination to improve swing efficiency and unleash core and other muscle power into the sports swing. The device enhances the athlete's ability to train muscle memory and achieve a swing that is repeatable, thus increasing confidence and ball striking performance. The device enables the player to train in partial swing and full swing modes, can be custom fitted with variable sizing and resistance levels, and can be utilized indoors and outdoors. The device may comprise a catch and release device configured to attach to the overall device system. The device may be modular such that the catch and release device and its attachment component can be utilized with the entire swing system training device, or separately for full swing use, for specific muscle memory development and swing training from actually striking balls.

This device focuses on improved method training of the core and other muscles used in making the sports swing, in particular, the muscles associated with the feet, legs, torso, back, shoulders, arms, and hands. As shown in FIG. 1, leg training is enhanced by the unique cross placement of the resistance components that train the feet and legs to move in harmony with the hips and core. The hips are likewise connected to the arms just above the elbow with specifically varied lengths and resistance to train the hands, arms, shoulders, and back to move in harmony with the hips and core. Using this training method, the hips and core then bring the lower body and upper body into complete harmony, strength, and flexibility resulting in improved sports swing performance. By training with the methods described herein, the athlete trains for an improved sports swing based on core and other muscle fundamentals enhancing practice to improve, rather than repeating improper practice swing motions, enhancing the development of strength, flexibility, balance, coordination, weight shift, rhythmic timing, repeatability, and confidence. The device trains and strengthens the body's muscles to help achieve improved sports swing start position, execution, and finish, thus helping the athlete to improve the sports swing.

By using the device to practice the sports swing in a controlled and slow motion manner, the athlete is able to train strength, flexibility, coordination, weight shift, rhythmic timing, repeatability, and confidence. Once core and other muscle memory strength is developed and the athlete achieves improved flexibility and strength, swing speed can be varied with swing drills to further enhance swing improvement and further embed muscle memory. Use of the catch and release device enables the athlete to swing in a slower and more controlled manner with single arm follow through, and to achieve higher swing speeds with full swing capability.

The device may comprise a plurality of attachment and resistance components that work together to train the sports swing from the core and facilitate improved placement of the legs, torso, arms, neck, and head in making the proper sports swing through the specific placement of the attachment components and use of the resistance components. Placement of the attachment components may enable successful operation of the device. To assist with attachments placement understanding, terms will be used as follows: (1) the follow arm is the right arm for a right handed athlete and left arm for a left handed athlete; (2) the lead arm is the left arm for a right handed athlete and right arm for a left handed athlete; (3) the follow leg is the right leg for a right handed athlete and left leg for a left handed athlete; (4) the lead a leg is the left leg for a right handed athlete and right leg for a left handed athlete; (5) follow torso means the right side of the torso for a right handed athlete, and left side of the torso for a left handed athlete; and (6) lead torso means the left side of the torso for a right handed athlete, and right side of the torso for a left handed athlete.

Referring to FIG. 1, a sports swing muscle memory development device 100 comprises a first attachment component 102, a second attachment component 104, a third attachment component 106, a fourth attachment component 108, a fifth attachment component 110, a first connection component 112, a second connection component 114, a third connection component 116, a fourth connection component 118, a fifth connection component 120, a sixth connection component 122, a first resistance component 124, a second resistance component 126, a third resistance component 128, and a fourth resistance component 130. The above described components may be configured to attach to the athlete's body having a leading arm 132, a trailing arm 134, a torso 136, a leading leg 138, and a trailing leg 140.

The placement of each component (listed above) affects the ability of the device 100 to achieve its purpose and operate effectively for the athlete, and to facilitate improved strength, flexibility, coordination, weight shift, rhythmic timing, repeatability, and confidence training in the sports swing.

The leading arm 132, the trailing arm 134, the torso 136, the leading leg 138, and the trailing leg 140 may be the enclosed regions to be secured by the first attachment component 102, the second attachment component 104, the third attachment component 106, the fourth attachment component 108, and the fifth attachment component 110, and may define a swing relationship. The first attachment component 102, the second attachment component 104, the third attachment component 106, the fourth attachment component 108, and the fifth attachment component 110 may have a hollow cylindrical shape with an outer circumference and an inner circumference, such that as they are secured, or adjusted, the inner circumference conforms to the contour of the trailing arm 134, leading arm 132, the torso 136, the trailing leg 140, and the leading leg 138, respectively.

The first attachment component 102 may be secured to the trailing arm 134 just above the elbow to ensure stable position and proper resistance during the sports swing to facilitate training of the trailing arm 134 in the sports swing.

The second attachment component 104 may be secured to the leading arm 132 just above the elbow to ensure stable position and proper resistance during the sports swing to facilitate training of the leading arm 132 in the sports swing.

The third attachment component 106 may be secured to the torso 136 of the body to ensure stable position and resistance during the sports swing to provide connection to the torso 136 and primary body core with the leading arm 132, the trailing arm 134, the leading leg 138, and the trailing leg 140 to facilitate training of the torso 136 in the sports swing. The third attachment component 106 may be secured circumferentially around the waist portion of the torso 136 (e.g., between the hips and the ribcage).

The fourth attachment component 108 may be secured to the trailing leg 140 just above the knee to ensure stable position and resistance during the sports swing to provide the connection of the trailing leg 140 to the torso 136 and primary body core with specific resistance tension to the trailing leg 140 to facilitate training of the trailing leg 140 in the sports swing.

The fifth attachment component 110 may be secured to the leading leg 138 just below the knee ensure stable position during the sports swing to provide the connection of the leading leg 138 to the torso 136 and primary body core with specific resistance tension to the leading leg 138 to facilitate training of the leading leg 138 in the sports swing.

The first connection component 112 may be coupled to the first attachment component 102 and may be positioned on the inside of the trailing arm 134 (i.e., lateral leading position) to ensure stable position and resistance during the sports swing. The first connection component 112 may ensure that the elbow on the trailing arm 134 remains in proximity to the torso 136 when making the sports swing, and may provide connection to the third attachment component 106 via the first resistance component 124 and the third connection component 116.

The second connection component 114 may be coupled to the second attachment component 104 and may be positioned on the inside of the leading arm 132 (i.e., lateral trailing position) to ensure stable position and resistance during the sports swing. The second connection component 114 may ensure that the elbow on the leading arm 132 remains in proximity to the torso 136 when making the sports swing, and may provide connection to the third attachment component 106 via the second resistance component 126 and the fourth connection component 118.

The third connection component 116 may be coupled to the third attachment component 106 and may be positioned on the follow portion of the torso 136 (i.e., lateral trailing position) to ensure stable position and resistance during the sports swing. The third connection component 116 may ensure that the torso 136 is trained in connection with the trailing arm 134 and the leading leg 138 to drive the sports swing to enable efficient power when making the sports swing, and may provide connection to the first attachment component 102 (with catch and release capability, see further description below) via the first resistance component 124 and the first connection component 112 and the fifth attachment component 110 via the third resistance component 128 and the sixth connection component 122. In some embodiments, the third connection component 116 may be a catch and release device 200, as described in FIGS. 2A-2B.

The fourth connection component 118 may be coupled to the third attachment component 106 and may be positioned on the lead portion of the torso 136 (i.e., lateral leading position) to ensure stable position and resistance during the sports swing. The fourth connection component 118 may ensure that the torso 136 is trained in connection with the leading arm 132 and the trailing leg 140 to drive the sports swing to enable efficient power when making the sports swing. The fourth connection component 118 may provide connection to the second attachment component 104 via the second resistance component 126 and the second connection component 114 and may provide connection to the fourth attachment component 108 via the fourth resistance component 130 and the fifth connection component 120.

The fifth connection component 120 may be coupled to the fourth attachment component 108 and may be positioned on the inside of the trailing leg 140 (i.e., lateral leading position) just above the knee to ensure stable position, resistance, and lift during the sports swing. The fifth connection component 120 may ensure that the trailing leg 140 is trained in connection with the lead portion of the torso 136 to drive the sports swing to enable efficient power when making the sports swing, and may provide connection to the third attachment component 106 via the fourth resistance component 130 and the fourth connection component 118.

The sixth connection component 122 may be coupled to the fifth attachment component 110 and may be positioned on the outside of the leading leg 138 (i.e., lateral leading position) just below the knee to ensure stable position, resistance, and turn tension during the sports swing. The sixth connection component 112 may ensure that the leading leg 138 is trained in connection with the follow portion of the torso 136 to drive the sports swing to enable efficient power when making the sports swing, and may provide connection to the third attachment component 106 via the third resistance component 128 and the third connection component 116.

The first resistance component 124 may be located between the first attachment component 102 and the third attachment component 106 to ensure proper resistance during the sports swing, by connection of the trailing arm 134 to the follow portion of the torso 136, to drive the sports swing to enable efficient power when making the sports swing. The first resistance component 124 may have its length and tension altered by adjusting the coupling to the first connection component 112 and the third connection component 116.

The second resistance component 126 may be located between the second attachment component 104 and the third attachment component 106 to ensure proper resistance during the sports swing, by connection of the leading arm 132 to the lead portion of the torso 136, to drive the sports swing to unleash efficient power when making the sports swing. The second resistance component 126 may have its length and tension altered by adjusting the coupling to the second connection component 114 and the fourth connection component 118.

The third resistance component 128 may be located between the fifth attachment component 110 and the third attachment component 106 to ensure proper resistance during the sports swing, by connection of the leading leg 138 to the follow portion of the torso 136, to drive the sports swing to unleash efficient power when making the sports swing. The third resistance component 128 may have its length and tension altered by adjusting the coupling to the third connection component 116 and the sixth connection component 122.

The fourth resistance component 130 may be located between the fourth attachment component 108 and the third attachment component 106 to ensure proper resistance during the sports swing, by connection of the trailing leg 140 to the lead portion of the torso 136, to drive the sports swing to unleash efficient power when making the sports swing. The fourth resistance component 130 may have its length and tension altered by adjusting the coupling to the fourth connection component 118 and the fifth connection component 120.

In some embodiments, the third resistance component 128 may overlap the fourth resistance component 130, where the third resistance component 128 may be located further from the frontal plane of the body (as depicted in FIG. 1), or where the fourth resistance component 130 may be located further from the frontal plane of the body. In some embodiments, the third resistance component 128 and the fourth resistance component 130 may be coupled proximate to the point of overlap, restricting movement at the point of overlap.

In some embodiments, the first resistance component 124, the second resistance component 126, the third resistance component 128, and the fourth resistance component 130 may comprise materials such as bungee cords, elastomer devices, resistance bands, and/or other similar materials comprising elastic characteristics. The material used may be interchanged and each resistance component may be the same material or a different material. Each interchanged material utilized as a resistance component may have a same or different length and tension. The resistance components may have an elliptical or polygonal cross-section.

In some embodiments, one or more of the resistance components 124, 126, 128, and 130 may be permanently attached to one or more of the connection components 112, 114, 116, 118, 120, and 122. In some embodiments, one or more of the resistance components 124, 126, 128, and 130 may be removably attached to one or more of the connection components 112, 114, 116, 118, 120, and 122, such that a user may attach or detach the resistance components 124, 126, 128, and 130 to and from the connection components 112, 114, 116, 118, 120, and 122. In some embodiments, one or more of the connection components 112, 114, 116, 118, 120, and 122 may be permanently attached to one or more of the attachment components 102, 104, 106, 108, and 110. In some embodiments, one or more of the connection components 112, 114, 116, 118, 120, and 122 may be removably attached to one or more of the attachment components 102, 104, 106, 108, and 110, such that a user may attach or detach the connection components 112, 114, 116, 118, 120, and 122 to or from the attachment components 102, 104, 106, 108, and 110. In some embodiments, one or more of the attachment components 102, 104, 106, 108, and 110 may be removably attached to the user's (or athlete's) body, by attaching directly to the user's body and/or via a suit worn by the user. In some embodiments, one or more of the attachment components 102, 104, 106, 108, and 110 may be permanently attached to a suit or garment(s) worn by the user.

During a sports swing, the tension and the length of the resistance components may be altered via forces exerted via the leading arm 132, the trailing arm 134, the torso 136, the leading leg 138, and the trailing leg 140, and the resistance components may provide resistance to the leading arm 132, the trailing arm 134, the torso 136, the leading leg 138, and the trailing leg 140 as a result. Each of the resistance components may be released from their coupling to enable the exchange of materials or to alter the swing relationship by not providing resistance to one or more of the he leading arm 132, the trailing arm 134, the torso 136, the leading leg 138, and the trailing leg 140.

Figure 2A:
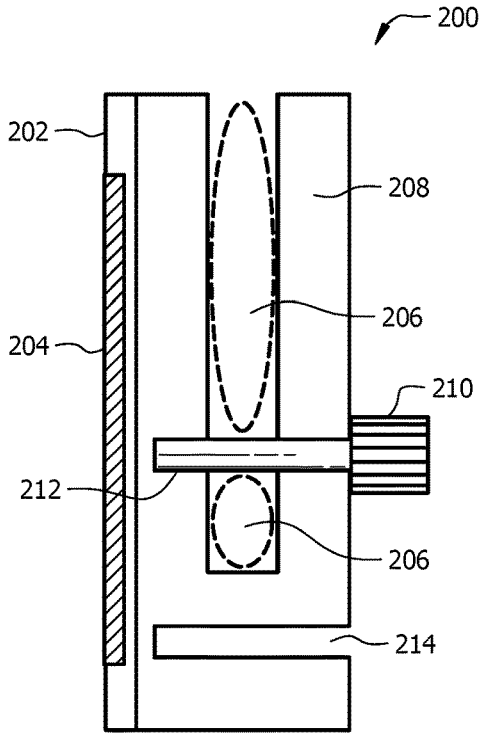
FIGS. 2A-2B illustrate an embodiment of a catch and release device 200.
Figure 2B:
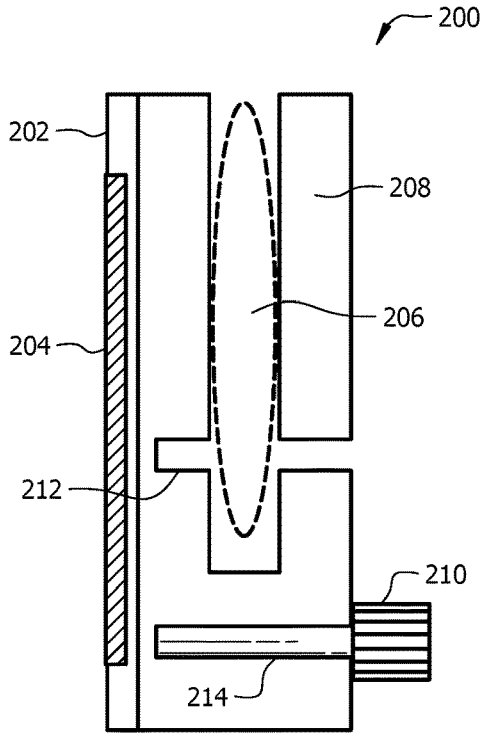

The device 100 described in FIG. 1 may comprise a catch and release device 200. Referring to FIGS. 2A and 2B, the catch and release device 200 may comprise a belt bracket 202, a belt slot 204, a slide release slot 206, a swing trainer catch and release device body 208, an insert locking pin 210, an insert locking pin locking slot 212, and an insert locking pin storage slot 214. In an embodiment, the insert locking pin 210 can be static, interlocking, spring loaded, screw loaded, or combinations thereof. In some embodiments, the insert locking pin locking slot 212, the insert locking pin storage slot 214, and/or the insert locking pin 210 may comprise threads or another similar surface feature to facilitate locking of the insert locking pin 210 into one of the slots 212 and 214.

The catch and release device 200 may be an embodiment of the third connection component 116 (described in FIG. 1). The catch and release device 200 may enable both slow and moderate motion swing training in the locked position for 360 degrees strength, flexibility, and muscle memory training. The catch and release device 200 may comprise a locked position, shown in FIG. 2A and FIG. 3A, wherein the insert locking pin 210 is positioned within the insert locking pin locking slot 212. The catch and release device 200 may also comprise an unlocked position, shown in FIG. 2B and FIG. 3B, where the insert locking pin 210 is positioned in the insert locking pin storage slot 214, which enables the athlete to complete a full swing by the release of the first resistance component 124 (which may comprise a catching object 224 attached to one end of the first resistance component 124) from the first attachment component 102. The catch and release device 200 can be used interchangeably by right-handed or left-handed players.

Figure 3A:
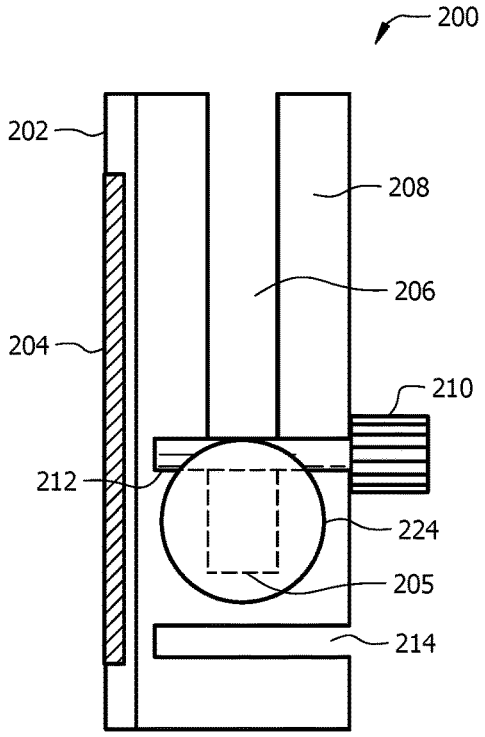
FIGS. 3A-3B illustrate other views of an embodiment of a catch and release device 200.
Figure 3B:
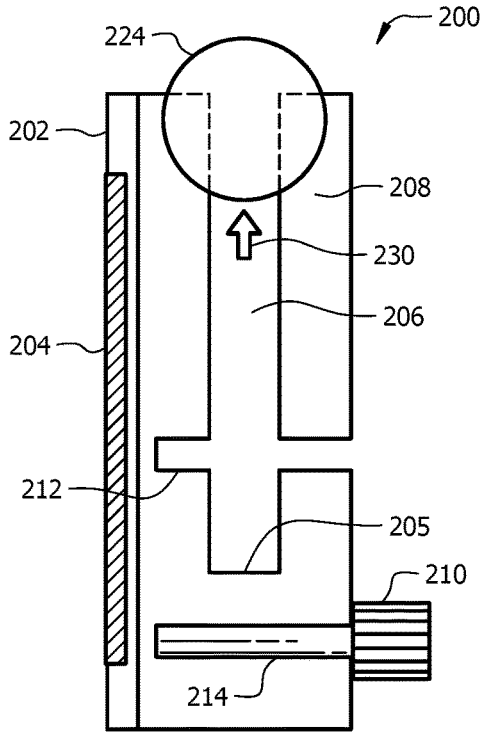

Referring to FIGS. 3A-3B, in the locked position shown in FIG. 3A, the catching object 224 and first resistance component 124 may be prevents by the insert locking pin 210 from sliding out of the slide release slot 206. In FIG. 3A, the first resistance component 124 and catching object 224 may slide between an end surface 205 of the slide release slot 206 and the insert locking pin 210, depending on the force applied to the first resistance component 124.

In the unlocked position shown in FIG. 3B, the catching object 224 and first resistance component 124 may be free to slide out of the slide release slot 206 (in the direct indicated by arrow 230), because the insert locking pin 210 is removed from the insert locking pin locking slot 212 and/or placed in the insert locking pin storage slot 214. In FIG. 3B, the first resistance component 124 and catching object 224 may slide between the end surface 205 of the slide release slot 206 and then out of the slide release slot 206, depending on the force applied to the first resistance component 124. As an example, the unlocked position shown in FIG. 3B may allow an athlete to complete a follow-through swing, while still providing resistance to a swing in the opposition direction, via the end surface 205 of the slide release slot 206.

The belt bracket 202 may be fixed to a training belt (such as third attachment component 106, described in FIG. 1) or other belts utilizing the belt insert slot 204. The belt bracket 202 may be affixed to the swing trainer catch and release device body 208. The belt bracket 202 and the belt insert slot 204 may position the swing trainer catch and release device body 208 relative to the third attachment component 106.

The belt insert slot 204 may be attached to the third attachment component 106 and/or may comprise a loop configured to slide along the third attachment component 106 to have its relative position along the third attachment component 106. The belt insert slot 204 may comprise a mechanism to allow release from the third attachment component 106.

The slide release slot 206 may be a void space of the swing trainer catch and release device body 208. The slide release slot 206 may allow a device, such as the first resistance component 124 and/or the catching object 224 of the first resistance component 124, to be inserted and be slideably coupled. The position of the first resistance component 124 and/or the catching object 224 in the slide release slot 206 may be based on the forces exerted from the body through the attachment devices.

Figure 4A:
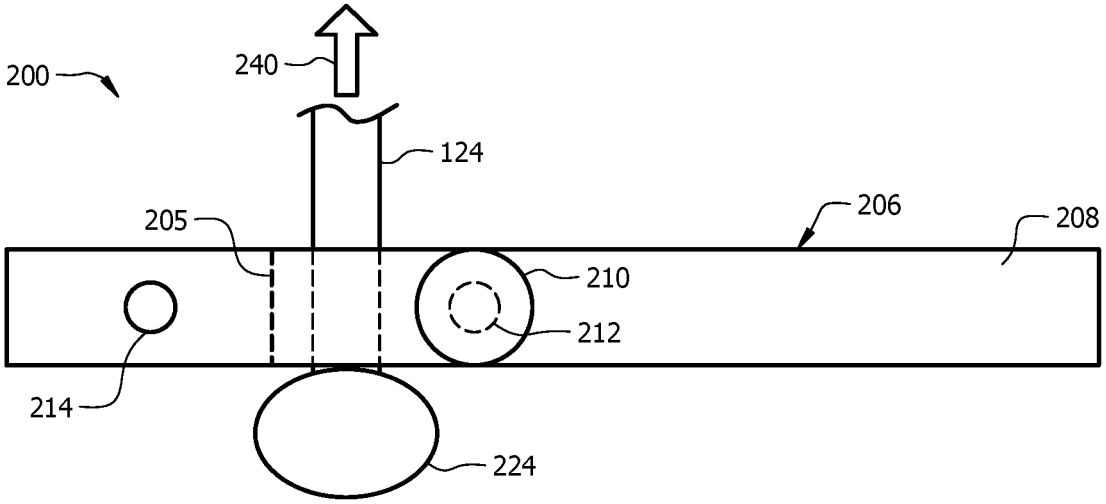
FIGS. 4A-4B illustrate other views of an embodiment of a catch and release device 200.
Figure 4B:
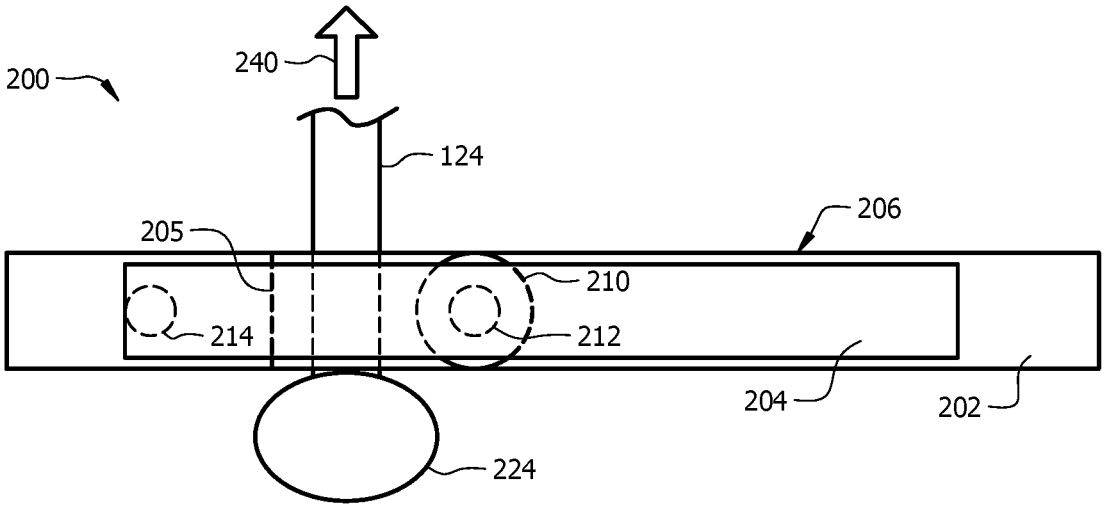

Referring to FIGS. 4A-4B, a side view of the catch and release device 200 is shown. FIGS. 4A-4B illustrate the locked position, described above in FIG. 2A and FIG. 3A. As described above, the catching object 224 may prevent the first resistance component 124 from sliding out of the slide release slot 206 in a vertical direction, indicated by arrow 240.

Figure 5A:
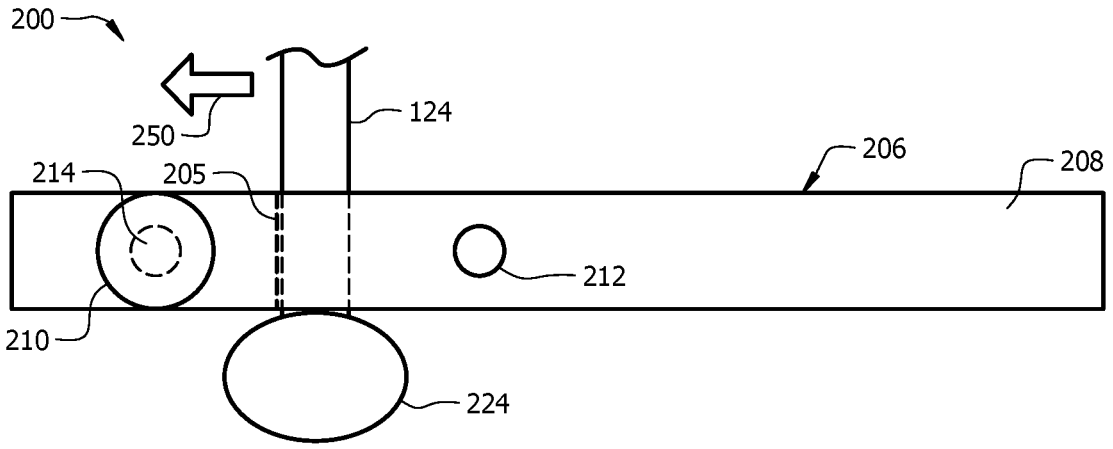
FIGS. 5A-5B illustrate other views of an embodiment of a catch and release device 200.
Figure 5B:
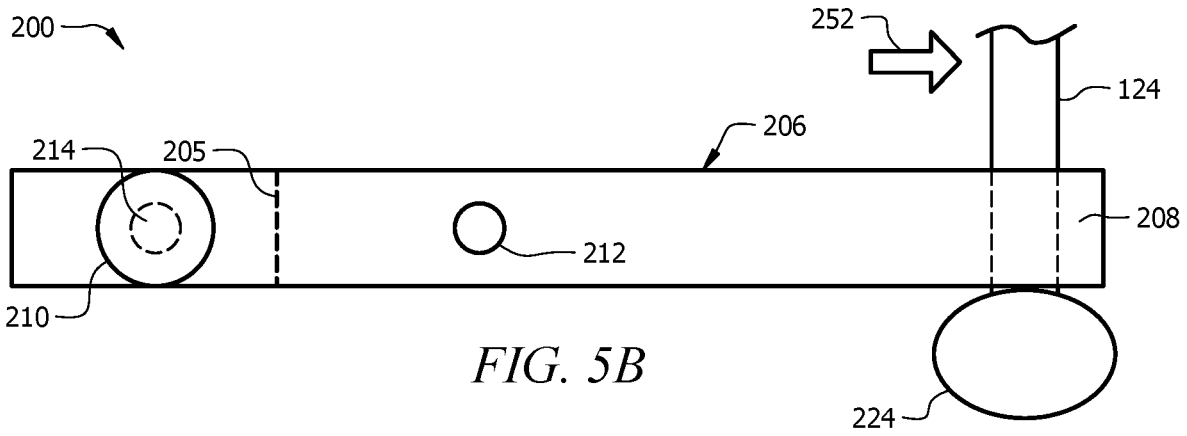

Referring now to FIGS. 5A-5B, the swing trainer catch and release device body 208 may be configured to receive a device such as the first resistance component 124, where the first resistance component 124 may comprise an catching object 224 that is larger than the slot 206, such that the catching object 224 resists any movement of the first resistance component 124 vertically with respect to the slot 206. The swing trainer catch and release device body 208 may guide the first resistance component 124 as forces are exerted on the first resistance component 124 via action of a body via the attachment devices. In some embodiments, the swing trainer catch and release device body 208 may comprise a rigid material. In some embodiments, the groove of the swing trainer catch and release device body 208 that defines the slide release slot 206 may be tapered to alter the force exerted on the first resistance component 124 as the first resistance component 124 slideably engages the swing trainer catch and release device body 208.

The insert locking pin 210 may be inserted into a designated space in the swing trainer catch and release device body 208, such as the insert locking pin locking slot 212 or the insert locking pin storage slot 214. The insert locking pin 210 may be a screw, spring loaded, snap, bolt or other insert affixation. As shown in FIG. 3A, when positioned in the insert locking pin locking slot 212, the insert locking pin 210 may prevent a device, such as the first resistance component 124 and/or the catching object 224 of the first resistance component 124, from slideably engaging the swing trainer catch and release device body 208 if the first resistance component 124 is located in the portion of the slide release slot 206 located between the insert locking pin 210 and the closed end of the swing trainer catch and release device body 208.

The insert locking pin locking slot 212 and the insert locking pin storage slot 214 may house the insert locking pin 210, the location of the insert locking pin 210 determining the machine state of the catch and release device 200.

The catch and release device 200 may allow the sports swing muscle memory development device 100 to be utilized in partial swing training (i.e., locked position, or first machine state), or full swing training (i.e., unlocked position, or second machine state). The catch and release device 200 may be permanently affixed to the training belt, or if not permanently affixed, used with any belt via the belt insert slot 204.

As shown in FIGS. 5A-5B, in use, the first resistance component 124 (resistance cord, band, etc.) may be inserted, where the first resistance component 124 may comprise the catching object 224 affixed to an end (e.g., larger than the slide release slot 206). In the first machine state, the catching object 224 may catch against the swing trainer catch and release device body 208 and the insert locking pin 210. In the second machine state, the catching object 224 may catch against the swing trainer catch and release device body 208 and hold when the user is moving in a first direction (as indicated by arrow 250), causing the catching object 224 to move into the slide release slot 206 (i.e., move back). The catching object 224 may slide through the slide release slot 206 of the swing trainer catch and release device body 208 and release when the user is moving in a second direction (as indicated by arrow 252), causing the catching object 224 to move out of the slide release slot 206 (i.e., move forward).

Figure 6:
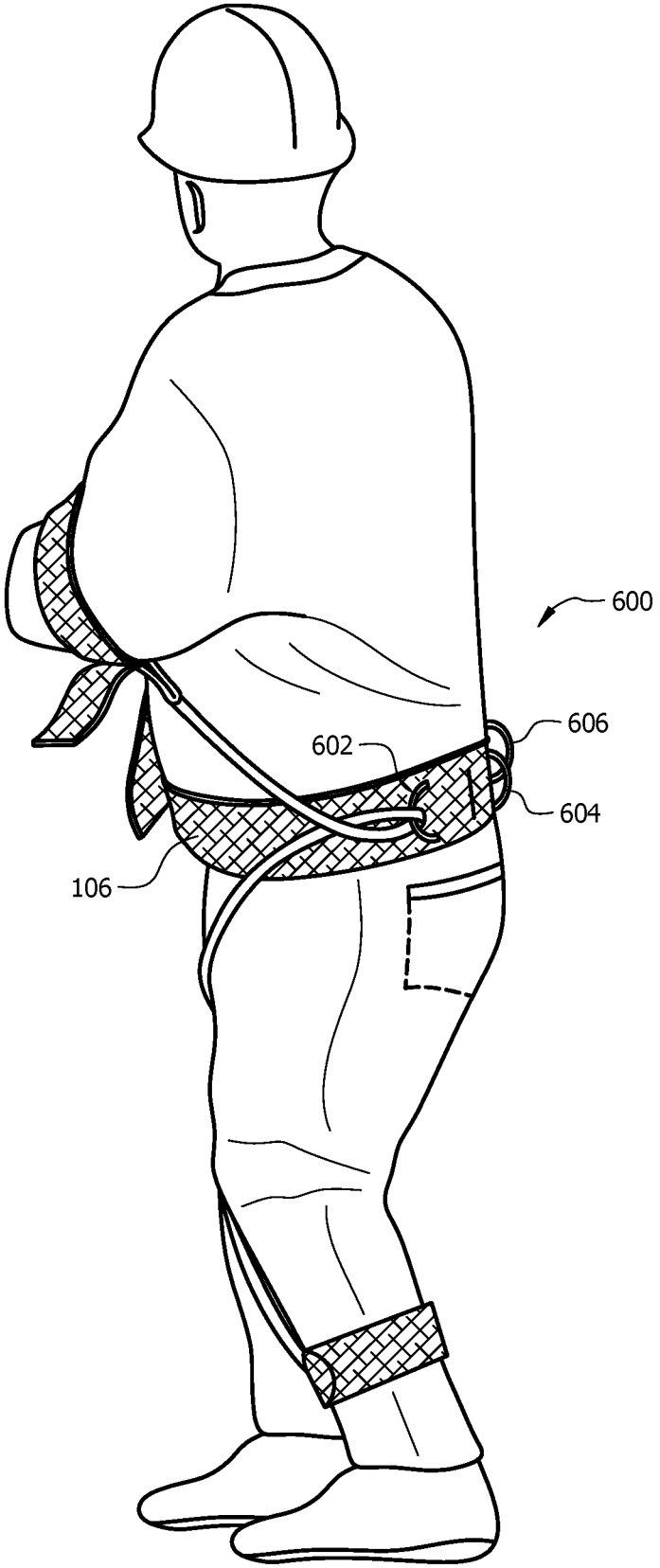
FIG. 6 illustrates an embodiment of a sports swing muscle memory development device 600.

Referring to FIG. 6, a sports swing muscle memory development device 600 may comprise a third attachment component 106, a first coupling location 602, a second coupling location 604, and/or a third coupling location 606.

The third attachment component 106 may secure to the torso of a body lower or higher on the torso depending on the sports swing being trained. The third attachment component 106 comprises the first coupling location 602, the second coupling location 604, and/or third coupling location 606. The first coupling location 602, the second coupling location 604, and/or the third coupling location 606 may be located in a permanent position along the third attachment component 106, or may be configured to have their position along the third attachment component 106 altered. For example, the first coupling location 602, the second coupling location 604, and/or the third coupling location 606 may be able to slide along a component of the third attachment component 106, such as a loop, and maintain a temporary position via a clamp or similar device. As depicted, the first coupling location 602, the second coupling location 604, and the third coupling location 606 are located in a lateral leading position, a posterior-lateral leading position, and a posterior position, respectively. Further coupling locations may be located in a lateral trailing position or a posterior-lateral trailing position.

The first coupling location 602, the second coupling location 604, and/or the third coupling location 606 may couple the fourth connection component 118 (described in FIG. 1) to the third attachment component 106. Similar coupling may be utilized for the third connection component 116.

Figure 7:
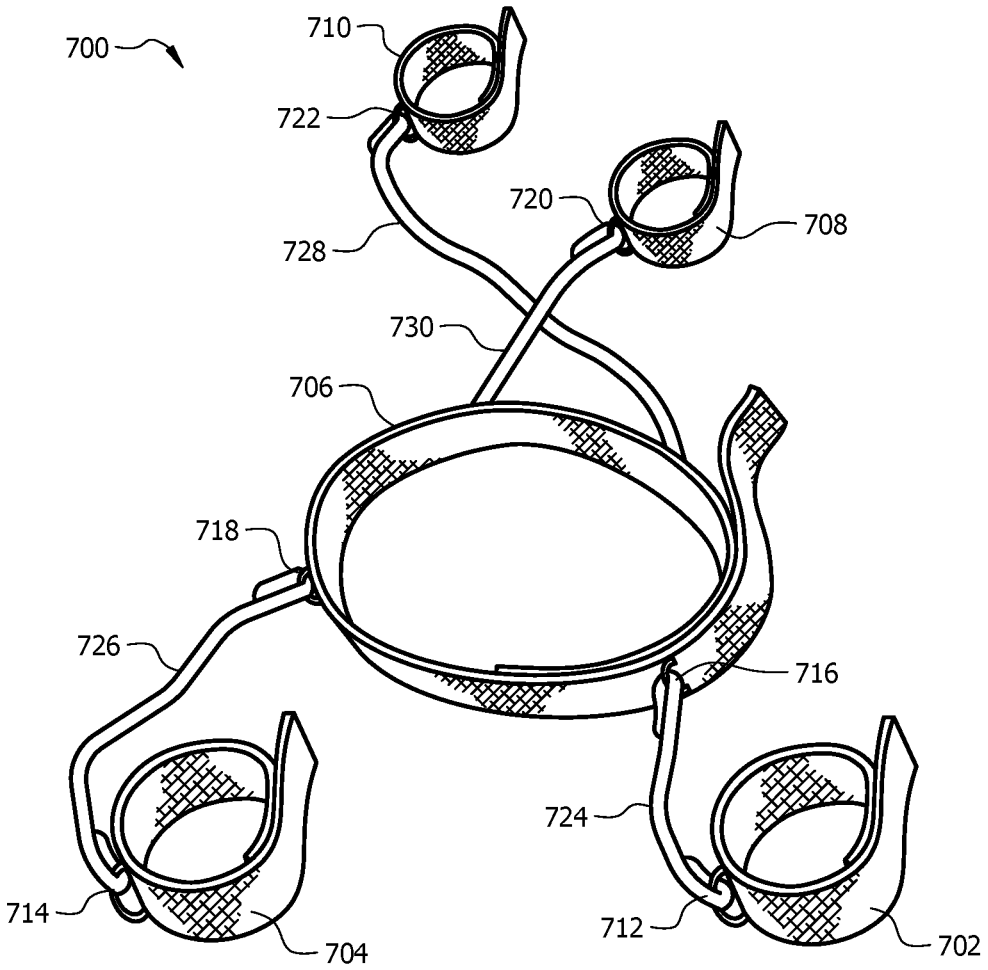
FIG. 7 illustrates an embodiment of a sports swing muscle memory development device 700.

Referring to FIG. 7, the sports swing muscle memory development device 700 comprises a first attachment component 702, a second attachment component 704, a third attachment component 706, a fourth attachment component 708, a fifth attachment component 710, a first connection component 712, a second connection component 714, a third connection component 716, a fourth connection component 718, a fifth connection component 720, an item 722, a first resistance component 724, a second resistance component 726, a third resistance component 728, and a fourth resistance component 730.

In some embodiments, the sports swing muscle memory development device 700 may be directly incorporated into clothing that may be worn by the user (athlete). For example, the first attachment component 702 may be incorporated into a sleeve of a garment that may be worn by the athlete, the second attachment component 704 may be incorporated into another sleeve of a garment that may be worn by the athlete, the third attachment component 706 may be incorporated into a pant leg of a garment that may be worn by the athlete, and the fourth attachment component 708 may be incorporated into another pant leg of a garment that may be worn by the athlete. The garment may comprise a shirt, shorts, pants, a jacket, coveralls, a jumpsuit, or any other garment that may be worn by the athlete.

Figure 8:
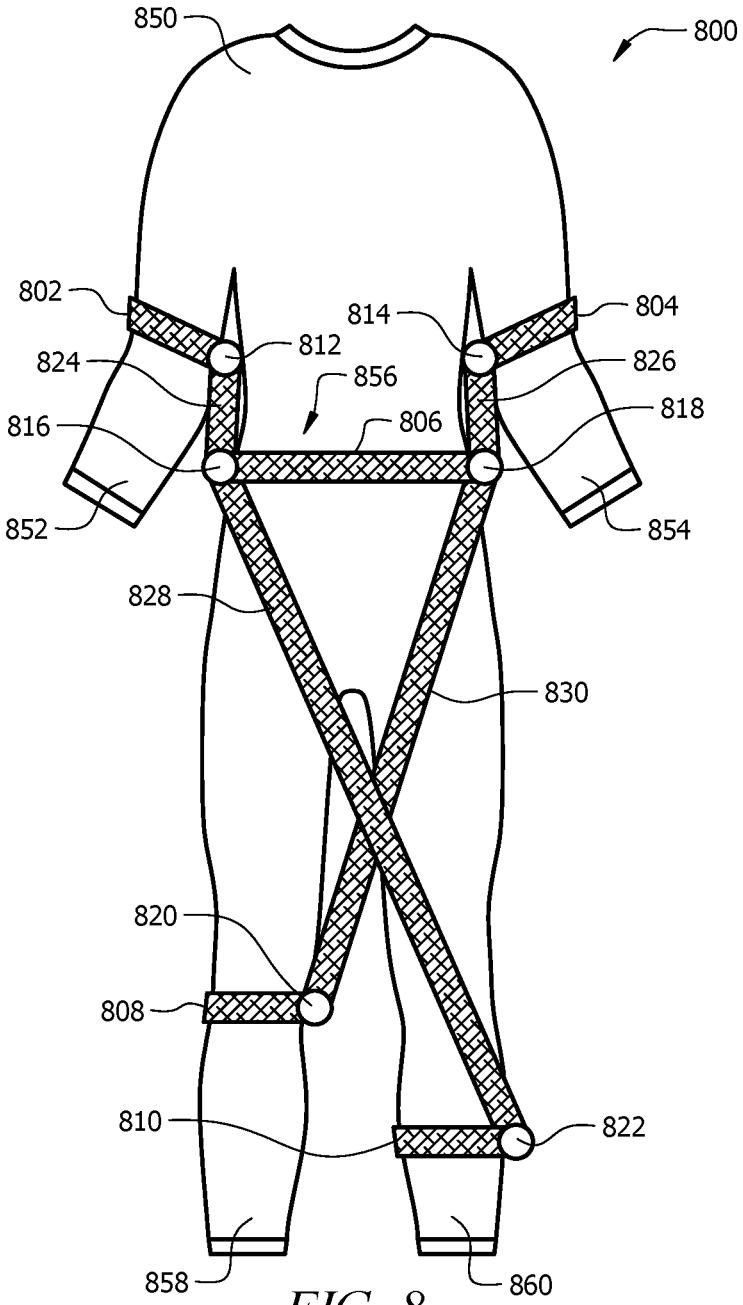
FIG. 8 illustrates an embodiment of a sports swing muscle memory development device 800 incorporated into a suit 850.

As an example, FIG. 8 illustrates a sports swing muscle memory development device 800 that may be incorporated into a suit 850 to be worn by an athlete, where the suit 850 may comprise a first sleeve 852, a second sleeve 854, a first pant leg 858, a second pant leg 860, and a waist portion 856. The components of the of the sports swing muscle memory development device 800 may be directly attached to the suit 850, such that an athlete may don the suit 850, and then the components may be positioned correctly on the athlete's body. In some embodiments, the suit 850 may comprise a top portion (comprising the sleeves 852 and 854) and a bottom portion (comprising the pant legs 858 and 860), wherein the suit 850 may be donned as two pieces that meet at the waist 856.

The sports swing muscle memory development device 800 may comprise a first attachment component 802 (which may be similar to the first attachment component 102), a second attachment component 804 (which may be similar to the second attachment component 104), a third attachment component 806 (which may be similar to the third attachment component 106), a fourth attachment component 808 (which may be similar to the fourth attachment component 108), a fifth attachment component 810 (which may be similar to the fifth attachment component 110), a first connection component 812 (which may be similar to the first connection component 112), a second connection component 814 (which may be similar to the second connection component 114), a third connection component 816 (which may be similar to the third connection component 116), a fourth connection component 818 (which may be similar to the fourth connection component 118), a fifth connection component 820 (which may be similar to the fifth connection component 120), a sixth connection component 822 (which may be similar to the sixth connection component 122), a first resistance component 824 (which may be similar to the first resistance component 124), a second resistance component 826 (which may be similar to the second resistance component 126), a third resistance component 828 (which may be similar to the third resistance component 128), and a fourth resistance component 830 (which may be similar to the fourth resistance component 130).

A sports swing muscle memory development device (which may also be known as a sports swing trainer), as disclosed herein, can be used in conjunction with various methods for training a user's sports swing related movements. For example, in an embodiment, a method for training movement of a sport swing user's feet, legs, and hips comprises slow to moderate speed motion with the sports swing trainer with focus on the feet, legs, and hips as would occur in the sports swing with focus on the specific feet muscles, then shifting the weight front and back to further develop the feet muscles and gain awareness of how the feet and toes are used in the sports swing to balance and deliver power, with ultimate goal of training the feet to be a natural and coordinated part of the swing, and letting the legs and hips move naturally with the feet when shifting weight as would occur in the sports swing, critical to balance and properly initiating the sports swing.

In another embodiment, a method for training movement of a sport swing user's hips, torso, shoulders, back, arms and hands comprises slow to moderate speed motion with the sports swing trainer of the sports swing motion with focus on the hips, torso, shoulders, back, arms and hands to further develop the hips, torso, shoulders, back, arms and hands muscles, with ultimate goal of training the hips, torso, shoulders, back, arms and hands to be a natural and coordinated part of the swing, and letting the feet, legs and hips move naturally with the feet when shifting weight as would occur in the sports swing.

In another embodiment, a method for training movement of a sport swing user's initial golf backswing comprises slow to moderate speed motion with the sports swing trainer of the initial backswing to the hips level with the wrists not breaking and the hands rotating naturally. For a baseball backswing, the method comprises slow to moderate speed motion to the batter stance with the hands just above shoulder level, in each case with focus on the initial backswing movement to train initial backswing muscles.

In another embodiment, a method for training movement of a sport swing user's upper golf backswing comprises slow to moderate speed motion with the sports swing trainer of the upper backswing above the hips level with the wrists breaking and the torso turning to the top of the golf swing position, with focus on the upper backswing movement to train upper backswing muscles.

In another embodiment, a method for training a sport swing user to hold the top of a sports swing or backswing comprises slow to moderate speed motion with the sports swing trainer to achieve the top of the sports swing and hold it to further develop the backswing muscles and to achieve a balanced and comfortable top of the swing position, critical for initiation of the down or forward motion of the sports swing.

In another embodiment, a method for training movement of a sport swing user's initial forward swing (a/k/a downswing) comprises slow to moderate speed motion with the sports swing trainer of the initial forward swing by starting with the feet, legs, and hips turning the torso only with the hands moving to the waist area but without releasing from the shoulders or unhinging the wrists, critical to swing plane and setting up the sports swing for a natural and coordinated release into the impact area.

In another embodiment, a method for training a sport swing user to hold the impact of a sports swing comprises slow to moderate speed motion with the sports swing trainer to achieve the impact area of the sports swing and hold it to further develop the impact area muscles and to achieve a balanced and comfortable impact area of the swing position, critical to swing plane, square impact, hit direction, and power.

In another embodiment, a method for training movement of a sport swing user's initial position of swing follow through comprises slow to moderate speed motion with the sports swing trainer of the sports swing follow through, critical to swing plane, hit direction, and power release in the impact area and training the follow through muscles.

In another embodiment, a method for training movement of a sport swing user's swing follow through with a catch and release device locked comprises slow to moderate speed motion with the sports swing trainer of the sports swing follow through past the initial follow through position with the lead arm only, critical to swing plane, hit direction, and power release through the impact area and training the follow through muscles.

In another embodiment, a method for training movement of a sport swing user's swing follow through with a catch and release device unlocked comprises slow, moderate, and faster speed motion with the sports swing trainer of the sports swing follow through past the initial follow through position with both arms, critical to swing plane, hit direction, and power release through the impact area and training the follow through muscles.

In another embodiment, a method for training movement of a sport swing user's swing follow through to a swing finish position comprises slow to moderate speed motion with the sports swing trainer of the sports swing follow through to this finish position with the lead arm only if catch and release device is locked, or with both arms if catch and release device is unlocked, critical to swing plane, hit direction, power release, and swing finish training the follow through finish muscles.

In another embodiment, a method for training a sport swing user to hold a swing finish position comprises slow to moderate speed motion with the sports swing trainer to achieve the swing finish position of the sports swing and hold it to further develop the swing finish muscles and to achieve a natural, balanced and comfortable finish of the sports swing, critical to balance and completing the sports swing.

In another embodiment, a method for training movement of a sport swing user's swing comprises combining the other methods disclosed herein in slow to moderate speed motion with the sports swing trainer to achieve the sports swing, critical to natural, balanced, and comfortable sports swing success.

What is claimed is:

1. A sports swing muscle memory development device comprising:

a plurality of attachment components, wherein each of the plurality of attachment components is configured to circumferentially secure a different enclosed region of a plurality of enclosed regions of a user's body, wherein the plurality of enclosed regions comprise each of a user's arms and each of a user's legs;

a plurality of connection components, wherein each of the plurality of connection components is coupleable to one or more of the plurality of attachment components; and a plurality of resistance components, wherein each of the plurality of resistance components is coupleable to one or more of the plurality of connection components, wherein one of the plurality of resistance components is a catching object resistance component which comprises a catching object attached at an end of the catching object resistance component, wherein the catching object is slideably coupled to a catch and release device, wherein one of the plurality of connection components comprises the catch and release device, and wherein the catch and release device is configurable to both (1) allow the catching object resistance component to be temporarily restrained by the catch and release device in a first state and (2) to allow the catching object resistance component to physically contact and to be released from the catch and release device in a second state without any alteration of the second state of the catch and release device.

2. The sports swing muscle memory development device of claim 1, wherein the plurality of attachment components are hollow cylinders, the hollow cylinders each having an inner circumference and an outer circumference, each of the inner circumference of the hollow cylinders configured to contact a different portion of the plurality of enclosed regions.

3. The sports swing muscle memory development device of claim 2, wherein each of the inner circumference of the hollow cylinders has a first contour, and wherein the first contour is configured to conform to a contour of at least one of the plurality of enclosed regions.

4. The sports swing muscle memory development device of claim 1, wherein the plurality of attachment components are further configured to adjustably secure the plurality of enclosed regions.

5. The sports swing muscle memory development device of claim 1, wherein the plurality of resistance components are releasably coupled.

6. The sports swing muscle memory development device of claim 1, wherein the plurality of resistance components have a length, a tension, and a cross-section, the cross-section being elliptical or polygonal.

7. The sports swing muscle memory development device of claim 6, wherein the length of the plurality of resistance components is adjustable.

8. The sports swing muscle memory development device of claim 6, wherein the tension of the plurality of resistance components is adjustable.

9. The sports swing muscle memory development device of claim 1, further comprising:

a first attachment component, wherein the first attachment component is configured to circumferentially secure a first enclosed region;

a second attachment component, wherein the second attachment component is configured to circumferentially secure a second enclosed region;

a third attachment component, wherein the third attachment component is configured to circumferentially secure a third enclosed region;

a fourth attachment component, wherein the fourth attachment component is configured to circumferentially secure a fourth enclosed region;

a fifth attachment component, wherein the fifth attachment component is configured to circumferentially secure a fifth enclosed region;

a first connection component, wherein the first connection component is coupleable to the first attachment component;

a second connection component, wherein the second connection component is coupleable to the second attachment component;

a third connection component, wherein the third connection component is coupleable to the third attachment component;

a fourth connection component, wherein the fourth connection component is coupleable to the third attachment component;

a fifth connection component, wherein the fifth connection component is coupleable to the fourth attachment component;

a sixth connection component, wherein the sixth connection component is coupleable to the fifth attachment component;

a first resistance component, wherein the first resistance component is coupleable to the first connection component and the third connection component;

a second resistance component, wherein the second resistance component is coupleable to the second connection component and the fourth connection component;

a third resistance component, wherein the third resistance component is coupleable to the third connection component and the sixth connection component; and a fourth resistance component, wherein the fourth resistance component is coupleable to the fourth connection component and the fifth connection component.

10. The sports swing muscle memory development device of claim 9, wherein:

the first enclosed region comprises a trailing arm;

the second enclosed region comprises a leading arm;

the third enclosed region comprises a torso;

the fourth enclosed region comprises a trailing leg; and the fifth enclosed region comprises a leading leg, wherein leading and trailing identify a swing relationship.

11. The sports swing muscle memory development device of claim 9, wherein:

the first attachment component is configured to circumferentially secure to the trailing arm proximal to the elbow;

the second attachment component is configured to circumferentially secure to the leading arm proximal to the elbow;

the third attachment component is configured to circumferentially secure to the torso from and between the ribcage and the hips;

the fourth attachment component is configured to circumferentially secure to the trailing leg proximal to the knee; and the fifth attachment component is configured to circumferentially secure to the leading leg distal to the knee.

12. The sports swing muscle memory development device of claim 9, wherein:

the first connection component is coupled to the first attachment component in a lateral leading position of the trailing arm;

the second connection component is coupled to the second attachment component in a lateral trailing position of the leading arm;

the third attachment component comprises one or more coupling locations, the third connection component and the fourth connection component are coupleable to the one or more coupling locations;

the fifth connection component is coupled to the fourth attachment component in the lateral leading position of the trailing leg; and the sixth connection component is coupled to the fifth attachment component in the lateral leading position of the leading leg.

13. The sports swing muscle memory development device of claim 12, wherein the one or more coupling locations comprise:

the lateral leading position relative to the torso;

the lateral trailing position relative to the torso;

a posterior-lateral leading position relative to the torso;

a posterior-lateral trailing position relative to the torso; and a posterior position relative to the torso.

14. The sports swing muscle memory development device of claim 12, wherein each of the one or more coupling locations is adjustable.

15. The sports swing muscle memory development device of claim 9, wherein the third connection component is releasably coupled to the third attachment component.

16. The sports swing muscle memory development device of claim 9, wherein the first resistance component is coupled to the first connection component and is releasably coupled to the third connection component.

17. The sports swing muscle memory development device of claim 9, wherein the first resistance component is coupled to the first connection component and is not coupled to the third connection component.

18. The sports swing muscle memory development device of claim 17, wherein the first resistance component slidably engages the third connection component.

19. The sports swing muscle memory development device of claim 9, wherein the third connection component comprises two or more machine states, the two or more machine states comprising:

a first machine state coupling the first resistance component to the third connection component; and a second machine state releasing the first resistance component from the third connection component; and wherein the third connection component is operable to be altered from the first machine state to the second machine state and to be altered from the second machine state to the first machine state.

* * * * *